US007653321B2

(12) United States Patent
Yoshikawa

(10) Patent No.: US 7,653,321 B2
(45) Date of Patent: Jan. 26, 2010

(54) IMAGE FORMING APPARATUS, FIXING DEVICE, AND IMAGE FORMING METHOD

(75) Inventor: Takahiro Yoshikawa, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 202 days.

(21) Appl. No.: 11/830,457

(22) Filed: Jul. 30, 2007

(65) Prior Publication Data

US 2008/0031647 A1 Feb. 7, 2008

(30) Foreign Application Priority Data

Aug. 3, 2006 (JP) ..... 2006-212371

(51) Int. Cl.
*G03G 15/20* (2006.01)

(52) U.S. Cl. ..... 399/67; 399/329

(58) Field of Classification Search ..... 399/67, 399/328, 329, 45, 69, 70, 82, 341; 219/216
See application file for complete search history.

(56) References Cited

U.S. PATENT DOCUMENTS

| | | | | |
|---|---|---|---|---|
| 4,719,489 | A * | 1/1988 | Ohkubo et al. | 219/216 X |
| 5,832,340 | A * | 11/1998 | Kosagi et al. | 399/67 X |
| 6,501,914 | B2 | 12/2002 | Yoshikawa | 399/18 |
| 6,865,364 | B2 * | 3/2005 | Matsumoto | 399/329 |
| 7,043,185 | B2 | 5/2006 | Yoshikawa | 399/329 |
| 7,127,204 | B2 | 10/2006 | Satoh et al. | 399/329 |
| 2003/0128994 | A1 * | 7/2003 | Holubek et al. | 399/67 X |
| 2004/0264991 | A1 | 12/2004 | Yoshikawa | 399/69 |
| 2005/0111862 | A1 * | 5/2005 | Fuma et al. | 399/67 |
| 2005/0254846 | A1 * | 11/2005 | Yura et al. | 399/67 |
| 2006/0013607 | A1 | 1/2006 | Yoshikawa | 399/69 |
| 2006/0067753 | A1 * | 3/2006 | Katayanagi | 399/329 |
| 2006/0204265 | A1 | 9/2006 | Yoshikawa | 399/69 |
| 2007/0059020 | A1 | 3/2007 | Yoshikawa | 399/91 |
| 2009/0052927 | A1 | 2/2009 | Yoshikawa | |

FOREIGN PATENT DOCUMENTS

| | | |
|---|---|---|
| JP | 2001-159856 | 6/2001 |
| JP | 2002-351249 | 12/2002 |
| JP | 2003-270978 | 9/2003 |
| JP | 2004-20689 | 1/2004 |
| JP | 2004-109521 | 4/2004 |
| JP | 2004-287131 | 10/2004 |

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

An image forming apparatus includes an image forming device configured to form a toner image on a sheet and a fixing device configured to fix the toner image on the sheet. In the fixing device, a heater heats a fixing belt. A pressing roller applies a pressure to a fixing roller via the fixing belt to form a nip between the pressing roller and the fixing belt. A controller switches the fixing device between an increased pressure mode and a decreased pressure mode in a state in which the fixing roller and the pressing roller rotate. In the increased pressure mode, the pressing roller applies an increased pressure capable of fixing the toner image on the sheet to the fixing roller. In the decreased pressure mode, the pressing roller applies a decreased pressure incapable of fixing the toner image on the sheet to the fixing roller.

20 Claims, 9 Drawing Sheets

IMAGE FORMING APPARATUS, FIXING DEVICE, AND IMAGE FORMING METHOD

CROSS-REFERENCE TO RELATED APPLICATION

The present application is based on and claims priority to Japanese patent application No. 2006-212371 filed on Aug. 3, 2006 in the Japan Patent Office, the entire contents of which are hereby incorporated herein by reference.

BACKGROUND OF THE INVENTION

1. Field of the Invention

Exemplary aspects of the present invention relate to an image forming apparatus, a fixing device, and an image forming method, and more particularly, to an image forming apparatus, a fixing device, and an image forming method for fixing a toner image on a recording medium.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data by an electrophotographic method. For example, a charger charges a surface of a photoconductor. An optical writer emits a light beam onto the charged surface of the photoconductor to form an electrostatic latent image on the photoconductor according to image data. A developing device develops the electrostatic latent image with a developer (e.g., toner) to form a toner image on the photoconductor. The toner image is transferred from the photoconductor onto a sheet. A fixing device applies heat and pressure to the sheet bearing the toner image to fix the toner image on the sheet. Thus, the toner image is formed on the sheet.

The fixing device includes a fixing belt, a heating roller, a fixing roller, and a pressing roller. The fixing belt is formed in an endless belt-like shape, and is looped over the heating roller and the fixing roller. The pressing roller opposes the fixing roller via the fixing belt. The heating roller heats the fixing belt. Therefore, the fixing belt may be easily heated even when the fixing roller includes an elastic layer of reduced thermal conductivity.

A rubber roller is generally used as the fixing roller or the pressing roller. The rubber roller includes a core and silicon rubber formed on the core to cover the core. However, the fixing roller or the pressing roller may include silicon sponge of reduced thermal conductivity, as the elastic layer so as to increase a length in a sheet-conveyance direction of a nip formed between the pressing roller and the fixing roller opposing each other via the fixing belt and to prevent or reduce a thermal effect on the fixing belt.

When the silicon sponge is used under high pressure or under conditions in which the silicon sponge is substantially deformed, the silicon sponge may be permanently deformed by compression. To address this problem, in one example of a related-art fixing device, the pressing roller separates from the fixing roller and the fixing belt in a standby mode in which the fixing device does not perform a fixing operation.

Although the silicon sponge can withstand increased pressure temporarily applied while the fixing roller and the fixing belt do not rotate, silicon sponge durability does decrease when the fixing roller and the fixing belt are rotated and thereby deformed repeatedly. Even when the fixing device has a configuration in which the pressing roller separates from the fixing belt or applies reduced pressure to the fixing roller via the fixing belt in the standby mode, a load applied to the fixing roller and the fixing belt might not decrease while the fixing roller and the fixing belt rotate, and thus the durability of the fixing roller might not be improved thereby.

Since a Teflon®-coated surface layer of the fixing belt is soft, a sheet conveyed in the fixing device may generate surface asperities on the surface layer of the fixing belt. The surface asperities may generate gloss stripes on a toner image on a sheet. To address this problem, the pressing roller rotates at a linear speed different from a linear speed at which the fixing belt rotates at the nip formed between the pressing roller and the fixing belt, so as to reduce the surface asperities of the fixing belt. However, when the pressing roller and the fixing belt rotate at the different linear speeds, respectively, a sheet may generate paper dust while the sheet passes through the nip formed between the pressing roller and the fixing belt. The paper dust may scrape the fixing belt, resulting in decreased durability of the fixing belt and the fixing roller including the silicon sponge.

BRIEF SUMMARY OF THE INVENTION

This specification describes below an image forming apparatus according to an exemplary embodiment of the present invention. In one exemplary embodiment of the present invention, the image forming apparatus includes an image forming device configured to form a toner image on a sheet and a fixing device configured to fix the toner image on the sheet. The fixing device includes a fixing belt, a heater, a fixing roller, a pressing roller, and a controller. The fixing belt has an endless belt-like shape. The heater is configured to heat the fixing belt. The fixing roller includes an elastic layer including silicon sponge. The pressing roller is configured to apply a pressure to the fixing roller via the fixing belt to form a nip between the pressing roller and the fixing belt. At the nip, the toner image is fixed on the sheet. The controller is configured to switch the fixing device between an increased pressure mode and a decreased pressure mode in a state in which the fixing roller and the pressing roller rotate. In the increased pressure mode, the pressing roller applies an increased pressure capable of fixing the toner image on the sheet to the fixing roller. In the decreased pressure mode, the pressing roller applies a decreased pressure incapable of fixing the toner image on the sheet to the fixing roller.

This specification further describes below a fixing device for fixing a toner image on a sheet according to an exemplary embodiment of the present invention. In one exemplary embodiment of the present invention, the fixing device includes a fixing belt, a heater, a fixing roller, a pressing roller, and a controller. The fixing belt has an endless belt-like shape. The heater is configured to heat the fixing belt. The fixing roller includes an elastic layer including silicon sponge. The pressing roller is configured to apply a pressure to the fixing roller via the fixing belt to form a nip between the pressing roller and the fixing belt. At the nip, the toner image is fixed on the sheet. The controller is configured to switch the fixing device between an increased pressure mode and a decreased pressure mode in a state in which the fixing roller and the pressing roller rotate. In the increased pressure mode, the pressing roller applies an increased pressure capable of fixing the toner image on the sheet to the fixing roller. In the decreased pressure mode, the pressing roller applies a decreased pressure incapable of fixing the toner image on the sheet to the fixing roller.

This specification further describes below an image forming method for forming a fixed toner image on a sheet according to an exemplary embodiment of the present invention. In one exemplary embodiment of the present invention, the image forming method includes forming a toner image on a sheet, and rotating a pressing roller and a fixing roller in a state in which the pressing roller applies a pressure to the fixing roller via a fixing belt to form a nip between the pressing roller and the fixing belt. The method further includes controlling the pressing roller so as to apply a decreased pressure to the fixing roller via the fixing belt. The method further includes controlling the pressing roller so as to apply an increased pressure to the fixing roller via the fixing belt to fix the toner image on the sheet.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
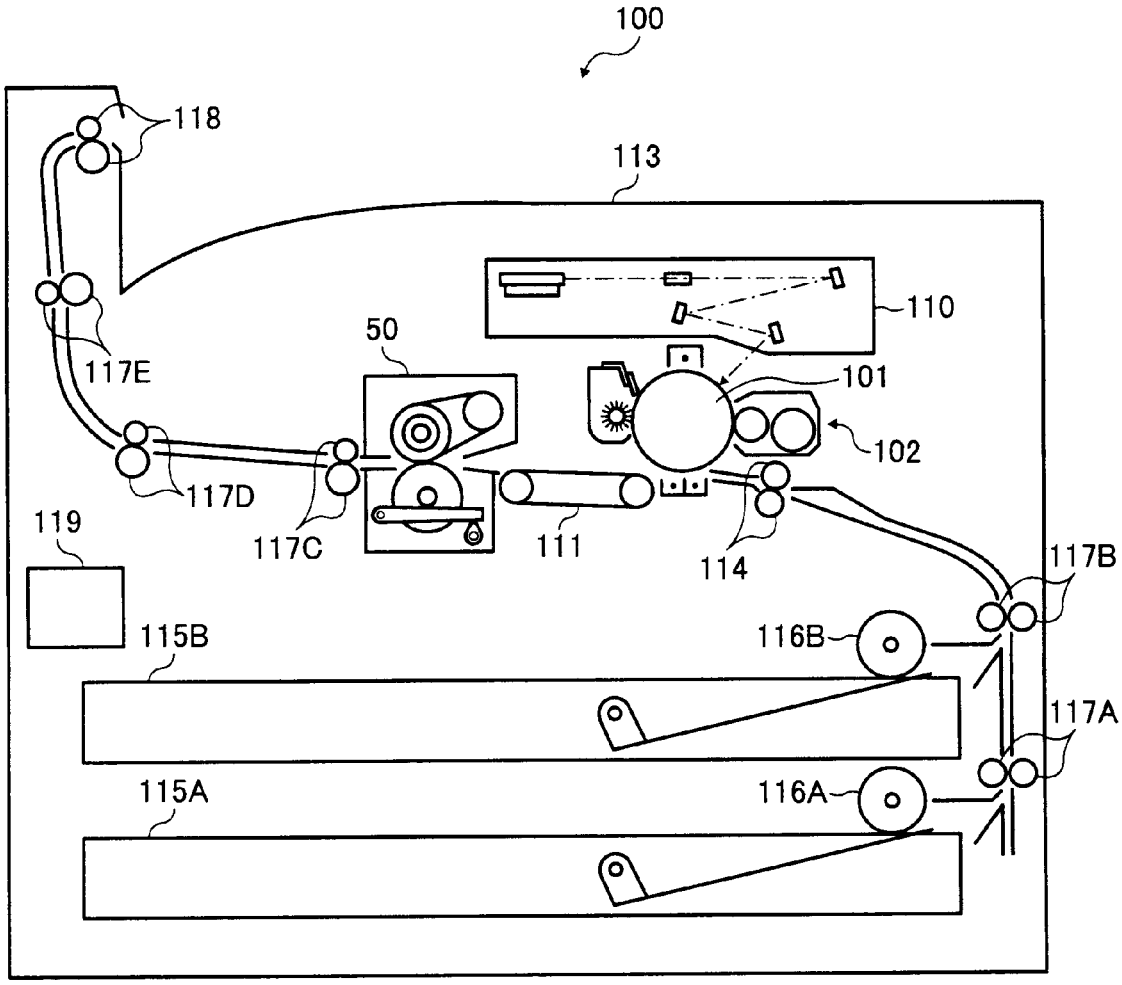
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

As illustrated in FIG. 1, the image forming apparatus 100 includes a writer 110, an image forming device 102, paper trays 115A and 115B, feeders 116A and 116B, conveying roller pairs 117A, 117B, 117C, 117D, and 117E, a registration roller pair 114, a conveying belt 111, a fixing device 50, an output roller pair 118, an output tray 113, and a controller 119. The image forming device 102 includes a photoconductor 101.

The image forming apparatus 100 can be a copying machine, a facsimile machine, a printer, a multifunction printer having two or more of copying, printing, scanning, and facsimile functions, or the like. According to this non-limiting exemplary embodiment of the present invention, the image forming apparatus 100 functions as a printer for printing an image on a recording medium by an electrophotographic method.

The writer 110 is disposed in an upper portion of the image forming apparatus 100. The writer 110 includes a laser output unit (not shown), a polygon mirror (not shown), an image forming lens (not shown), and a mirror (not shown). The laser output unit includes a light source (e.g., a laser diode). The writer 110 emits a laser beam onto a surface of the photoconductor 101 according to image data sent from an external device (not shown), such as a personal computer. For example, the light source emits a laser beam toward the polygon mirror. The polygon mirror is driven by a motor (not shown) to rotate at a constant high speed, and deflects the laser beam toward the image forming lens. The laser beam passes through the image forming lens and irradiates the mirror. The mirror deflects the laser beam onto the surface of the photoconductor 101 so that an electrostatic latent image is formed on the surface of the photoconductor 101.

The image forming device 102 is disposed under the writer 110, and further includes a charger (not shown), a developing device (not shown), a transfer device (not shown), a cleaner (not shown), and a discharger (not shown). The charger, the developing device, the transfer device, the cleaner, and the discharger are arranged around the photoconductor 101. The charger uniformly charges the surface of the photoconductor 101. The developing device develops the electrostatic latent image formed on the surface of the photoconductor 101 with a developer (e.g., toner) to form a toner image on the photoconductor 101.

The paper trays 115A and 115B are disposed in a lower portion of the image forming apparatus 100, and load a recording medium (e.g., one or more sheets). The feeder 116A or 116B feeds sheets one by one from the paper tray 115A or 115B toward the conveying roller pair 117A or 117B, respectively. The conveying roller pairs 117A, 117B, 117C, 117D, and 117E are provided on a conveying path extending from the paper tray 115A or 115B to the output tray 113. The conveying roller pair 117A or 117B feeds the sheet fed by the feeder 116A or 116B, respectively, upward toward the registration roller pair 114.

The registration roller pair 114 feeds the sheet toward the photoconductor 101 at a proper time when the toner image formed on the photoconductor 101 is transferred onto the sheet. In the image forming device 102, the transfer device includes a transfer charger (not shown) and a separating charger (not shown) disposed adjacent to the transfer charger. The transfer charger transfers the toner image formed on the photoconductor 101 onto the sheet. The separating charger separates the sheet from the photoconductor 101. The cleaner removes residual toner not transferred on the sheet and thereby remaining on the surface of the photoconductor 101 from the photoconductor 101. The discharger discharges the surface of the photoconductor 101.

The conveying belt 111 connects the photoconductor 101 to the fixing device 50, and conveys the sheet bearing the toner image toward the fixing device 50. The fixing device 50 applies heat and pressure to the sheet bearing the toner image to fix the toner image on the sheet. The conveying rollers 117C, 117D, and 117E feed the sheet bearing the fixed toner image toward the output roller pair 118. The output roller pair 118 feeds the sheet bearing the fixed toner image onto the output tray 113. The output tray 113 is disposed on a top of the image forming apparatus 100, and receives the sheet fed by the output roller pair 118. The controller 119 controls operations of the image forming apparatus 100.

As described above, according to this non-limiting exemplary embodiment, the image forming device 102 includes the charger for uniformly charging the surface of the photoconductor 101. However, the image forming device 102 may include a charging roller for contacting the surface of the photoconductor 101 to charge the surface of the photoconductor 101. Further, the image forming device 102 includes the transfer charger. However, the image forming device 102 may include a transfer roller or a transfer belt for contacting the surface of the photoconductor 101 to transfer the toner image formed on the photoconductor 101 onto the sheet. The writer 110 uses a laser scanning method. However, the writer 110 may include an exposing device including an LED (light-emitting diode) array and an image forming element.

Figure 2:
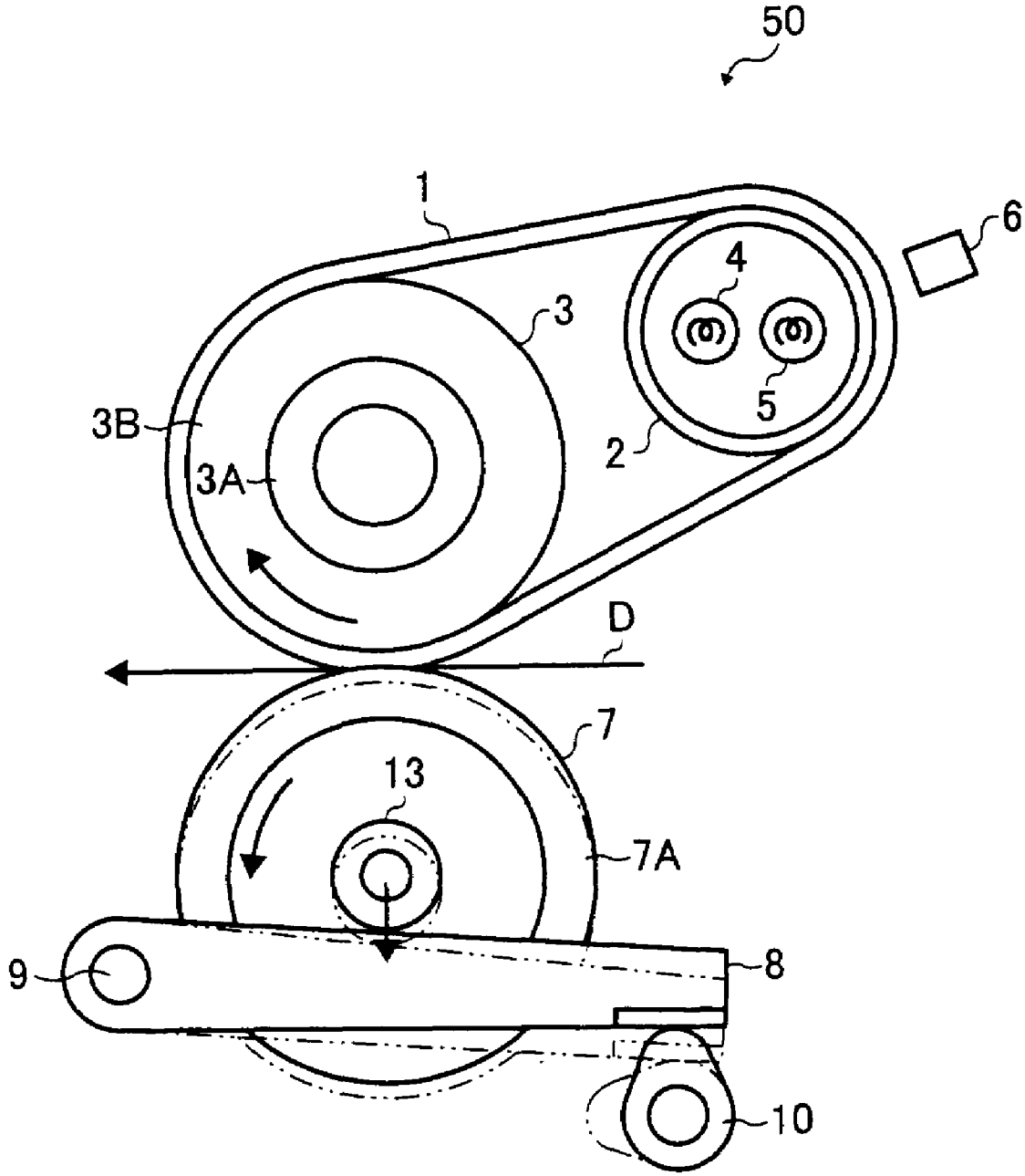
FIG. 2 is a sectional front view of a fixing device included in the image forming apparatus shown in FIG. 1.

FIG. 2 is a sectional view of the fixing device 50. As illustrated in FIG. 2, the fixing device 50 includes a fixing belt 1, a heating roller 2, heaters 4 and 5, a fixing roller 3, a temperature sensor 6, a pressing roller 7, a bearing 13, a pressing lever 8, a swing axis 9, and a cam 10. The fixing roller 3 includes a core 3A and an elastic layer 3B. The pressing roller 7 includes an elastic layer 7A.

The fixing belt 1 is looped over the heating roller 2 and the fixing roller 3. The pressing roller 7 presses the fixing roller 3 via the fixing belt 1.

The fixing belt 1 is formed in an endless belt-like shape, and includes a base, a silicon rubber layer, and a surface layer. The base includes a metal film, such as nickel (Ni) and stainless steel (SUS), and a resin film, such as polyimide (PI) and polyamidimide (PAI). The silicon rubber layer is formed on the base. The surface layer includes fluoroplastic and is formed on the silicon rubber layer. The heating roller 2 is formed in a metal pipe-like shape. The heaters 4 and 5 are provided in a hollow of the heating roller 2, and heat the fixing belt 1 via the heating roller 2. In the fixing roller 3, the elastic layer 3B including silicon sponge is formed on the core 3A. A driver (not shown) rotatably drives the fixing roller 3. The rotating fixing roller 3 drives the fixing belt 1. The temperature sensor 6 is provided near the heating roller 2, and detects a temperature of the fixing belt 1 to control heating performed by the heaters 4 and 5 (e.g., to control turning on and off of the heaters 4 and 5). According to this non-limiting exemplary embodiment, the temperature sensor 6 includes a plurality of sensors arranged along an axial direction of the heating roller 2 to detect the temperature of the fixing belt 1 at a center and both ends in the axial direction of the heating roller 2.

The pressing roller 7 includes a core (not shown), the elastic layer 7A, and a surface layer (not shown). The elastic layer 7A includes a rubber, and is formed on the core. The surface layer includes fluoroplastic, and is formed on the elastic layer 7A to cover the elastic layer 7A.

The bearing 13 rotatably supports a shaft of the pressing roller 7. The pressing lever 8 contacts a lower portion of the bearing 13. The swing axis 9 swingably supports the pressing lever 8 at one end of the pressing lever 8. The cam 10 rotates to swing the pressing lever 8. For example, a cam motor (not shown) rotates the cam 10. The rotating cam 10 swings the pressing lever 8. The swinging pressing lever 8 adjusts a pressure (e.g., a pressing force) applied by the pressing roller 7 to the fixing roller 3 via the bearing 13. When the cam 10 is at an increased pressure position illustrated in a solid line, the pressing roller 7 applies an increased pressure (e.g., a pressure capable of fixing a toner image on a sheet) to the fixing roller 3. When the cam 10 is at a decreased pressure position illustrated in a broken line, the pressing roller 7 applies a decreased pressure (e.g., a pressure incapable of fixing a toner image on a sheet) to the fixing roller 3. According to this non-limiting exemplary embodiment, even when the cam 10 is at the decreased pressure position, the pressing roller 7 does not separate from the fixing belt 1 and the fixing roller 3. When the pressing lever 8 is at an increased pressure position illustrated in a solid line, the fixing device 50 is in a fixing mode (i.e., an increased pressure mode). When the pressing lever 8 is at a decreased pressure position illustrated in a broken line, the fixing device 50 is in a non-fixing mode (i.e., a decreased pressure mode).

A sheet (not shown) bearing a toner image to be fixed is conveyed in a direction D. The elastic layer 3B of the fixing roller 3 and the elastic layer 7A of the pressing roller 7 are deformed to form a nip between the fixing roller 3 and the pressing roller 7 at a portion where the fixing roller 3 opposes the pressing roller 7 via the fixing belt 1. While the sheet passes through the nip, the fixing belt 1 heated by the heating roller 2 applies heat to the sheet and the nip applies pressure to the sheet. The heat and pressure fix the toner image on the sheet. After the sheet bearing the fixed toner image passes through the nip, a force for separating the sheet from the fixing belt 1 (e.g., a curvature of the fixing roller 3) overcomes an adhesion force of melted toner for causing the toner image to adhere to the fixing belt 1. Thus, the sheet separates from the fixing belt 1.

The silicon sponge included in the elastic layer 3B of the fixing roller 3 may be easily damaged or permanently deformed due to an increased load applied to the silicon sponge with time. To address this problem, according to this non-limiting exemplary embodiment, the position of the pressing lever 8 is changed to decrease the pressure applied by the pressing roller 7 to the fixing roller 3.

When the fixing device 50 is in the fixing mode, the elastic layer 3B receives an increased load. When the fixing roller 3 is not rotated, the increased load applied to the elastic layer 3B may cause permanent deformation of the elastic layer 3B, but the increased load may be applied to a particular portion of the elastic layer 3B for several hours. When the cam 10 rotates to move the pressing lever 8 to the decreased pressure position illustrated in the broken line so that the fixing device 50 is in the non-fixing mode, the increased load applied to the particular portion of the elastic layer 3B, while the fixing roller 3 does not rotate, may not cause permanent deformation of the elastic layer 3B. On the contrary, when the fixing roller 3 rotates while the pressing lever 8 is positioned at the increased pressure position illustrated in the solid line (i.e., while the fixing device 50 is in the fixing mode), a force is repeatedly applied to the elastic layer 3B. As a result, the elastic layer 3B may be damaged.

According to this non-limiting exemplary embodiment, the fixing device 50 is in the fixing mode while the sheet passes through the nip formed between the fixing belt 1 and the pressing roller 7. While the sheet does not pass through the nip, the pressure applied by the pressing roller 7 to the fixing roller 3 is decreased so that the fixing device 50 is in the non-fixing mode. Namely, a time period when the fixing roller 3 rotates and receives the increased load is decreased so as to improve durability of the fixing roller 3.

According to this non-limiting exemplary embodiment, the fixing device 50 enters the fixing mode when a predetermined time period elapses after a sheet is fed from the paper tray 115A or 115B (depicted in FIG. 1). The fixing device 50 enters the non-fixing mode when a sheet sensor (not shown) provided downstream from the fixing device 50 in a sheet-conveyance direction detects the sheet. However, the fixing device 50 may enter the fixing mode based on a time when the registration roller pair 114 (depicted in FIG. 1) is turned on or a time when a sensor (not shown) provided at an entrance to the fixing device 50 detects a sheet. The fixing device 50 may enter the non-fixing mode based on a time when a sensor (not shown) provided on or near the output tray 113 (depicted in FIG. 1) detects a sheet.

Figure 3:
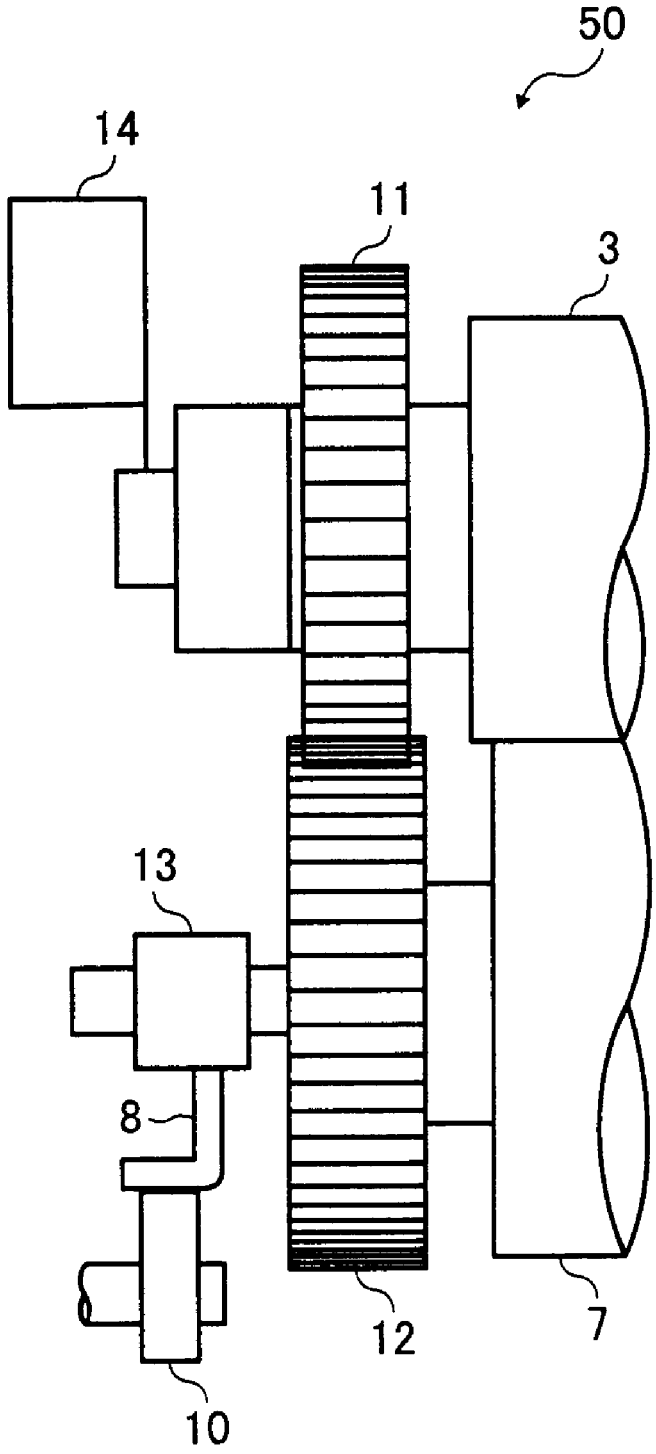
FIG. 3 is a sectional side view of the fixing device shown in FIG. 2.

FIG. 3 is a side view of the fixing device 50. As illustrated in FIG. 3, the fixing device 50 further includes a fixing motor 14, a fixing roller gear 11, and a pressing roller gear 12.

The fixing motor 14 serves as a driver for generating a driving force for driving the fixing device 50. The fixing roller gear 11 is attached to a shaft of the fixing roller 3. The driving force generated by the fixing motor 14 is transmitted to the fixing roller gear 11 via a gear (not shown) so as to rotate the fixing roller 3. The pressing roller gear 12 is attached to the shaft of the pressing roller 7, and engages with the fixing roller gear 11. Thus, the driving force transmitted via the fixing roller gear 11 and the pressing roller gear 12 rotates the pressing roller 7.

Figure 4:
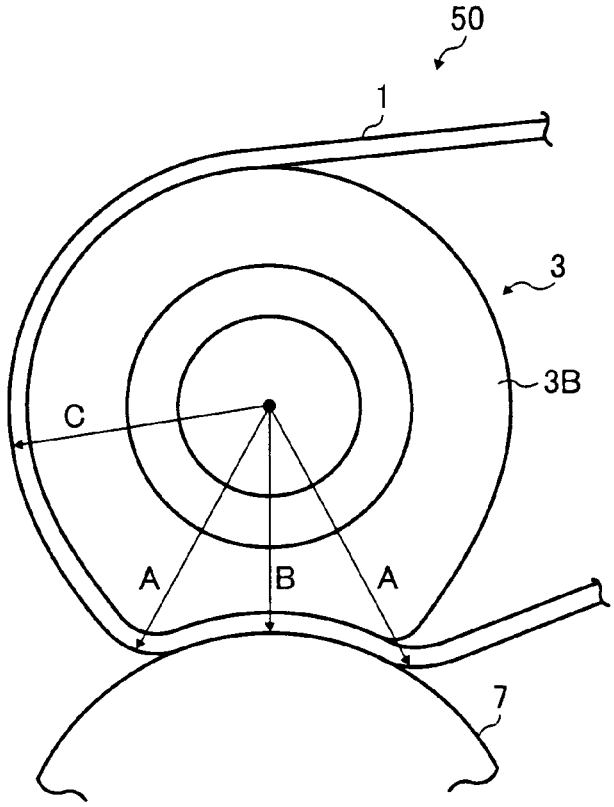
FIG. 4 is a sectional front view of a fixing roller included in the fixing device shown in FIG. 3.

FIG. 4 is an illustration for explaining deformation of the elastic layer 3B of the fixing roller 3 at the nip formed between the fixing roller 3 and the pressing roller 7. As illustrated in FIG. 4, the fixing roller 3 has a radius C (i.e., a distance between a center of the fixing roller 3 and a surface of the fixing belt 1) at a position other than the nip formed between the fixing roller 3 and the pressing roller 7. However, the fixing roller 3 has a radius A (i.e., a distance between the center of the fixing roller 3 and the surface of the fixing belt 1) at an entrance to and an exit from the nip formed between the fixing roller 3 and the pressing roller 7. The radius A is greater than the radius C. Therefore, a circumferential speed (e.g., a linear speed) of the fixing belt 1 at the nip is substantially identical to a circumferential speed of the fixing belt 1 at a position at which the fixing roller 3 has the radius A, although the fixing roller 3 has a radius B smaller than the radius A at a part of the nip. The smaller radius B is created by a pressure applied by the pressing roller 7 to the fixing roller 3.

When the fixing device 50 is in the non-fixing mode, the nip formed between the fixing roller 3 and the pressing roller 7 has a length in the sheet-conveyance direction smaller than a length formed in the fixing mode. The radius A at the entrance to and the exit from the nip is equivalent or close to the radius C at a position other than the nip. Therefore, the circumferential speed of the fixing belt 1 at the nip in the non-fixing mode is smaller than the circumferential speed in the fixing mode.

According to this non-limiting exemplary embodiment, a driving force is transmitted from the fixing roller 3 to the pressing roller 7 via the fixing roller gear 11 and the pressing roller gear 12 (depicted in FIG. 3). Therefore, the circumferential speed (e.g., the linear speed) of the pressing roller 7 does not substantially vary depending on the fixing mode and the non-fixing mode. When the fixing roller gear 11 and the pressing roller gear 12 are configured to adjust the circumferential speed (e.g., the linear speed) of the fixing belt 1 to be substantially equal to the circumferential speed (e.g., the linear speed) of the pressing roller 7 at the nip in the fixing mode, the circumferential speed of the fixing belt 1 is smaller than the circumferential speed of the pressing roller 7 in the non-fixing mode. Namely, the fixing belt 1 and the pressing roller 7 have the circumferential speeds different from each other.

Even when a sheet generates paper dust during a fixing operation, the paper dust may not scrape a Teflon®-coated surface layer of the fixing belt 1, because the fixing belt 1 and the pressing roller 7 rotate at substantially identical speeds in the fixing mode while the sheet passes through the nip formed between the fixing belt 1 and the pressing roller 7. While the sheet does not pass through the nip, the fixing belt 1 and the pressing roller 7 rotating at linear speeds different from each other may scatter paper dust in the non-fixing mode in which the pressing roller 7 applies a decreased pressure to the fixing roller 3 via the fixing belt 1. Thus, the number of scrapes of the fixing belt 1 by paper dust may be reduced. The pressing roller 7 rotating at the linear speed different from the linear speed of the fixing belt 1 may reduce surface asperities of the fixing belt 1, suppressing formation of gloss stripes. Thus, the fixing device 50 may improve durability of the elastic layer 3B and the fixing belt 1 while suppressing formation of gloss stripes.

Figure 5:
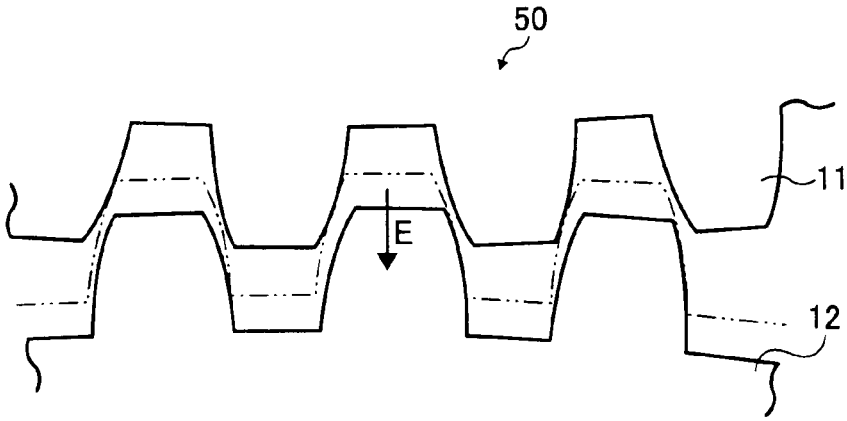
FIG. 5 is a side view of a fixing roller gear and a pressing roller gear included in the fixing device shown in FIG. 3.

As illustrated in a solid line in FIG. 5, the fixing roller gear 11 and the pressing roller gear 12 engage with each other even in the non-fixing mode, so that a driving force is transmitted from the fixing roller gear 11 to the pressing roller gear 12. Thus, even in the non-fixing mode in which the pressing roller 7 (depicted in FIG. 4) applies a decreased pressure to the fixing roller 3 (depicted in FIG. 4), the pressing roller 7 may be driven. Accordingly, the fixing belt 1 (depicted in FIG. 4) and the pressing roller 7 may rotate at linear speeds different from each other. In FIG. 5, a broken line illustrates a position of the pressing roller gear 12 in the fixing mode. The pressing roller gear 12 moves in a direction E from the position in the fixing mode to a position in the non-fixing mode illustrated in the solid line.

As illustrated in FIG. 4, the fixing roller 3 and the pressing roller 7 may rotate for a long time period during start-up, that is, when the fixing device 50 is activated and heated from a room temperature up to a fixing temperature after the fixing device 50 is powered on or when the fixing device 50 is activated and heated from an energy saving temperature up to a fixing temperature. For example, the fixing device 50 is heated from a room temperature up to a fixing temperature while the fixing belt 1 is rotated. When the fixing roller 3 and the pressing roller 7 are rotated in the fixing mode, the fixing roller 3 and the pressing roller 7 rotate for an increased number of rotations in a state in which an increased load is applied to the fixing roller 3 and the fixing belt 1. According to this non-limiting exemplary embodiment, the fixing roller 3 and the pressing roller 7 rotate in the non-fixing mode during start-up. Thus, the fixing roller 3 and the pressing roller 7 rotate for a decreased number of rotations in a state in which an increased load is applied to the fixing roller 3 and the fixing belt 1, resulting in an improved durability of the fixing belt 1 and the silicon sponge included in the elastic layer 3B of the fixing roller 3. Even in the non-fixing mode, the fixing roller 3 and the pressing roller 7 contact the fixing belt 1 in a substantial contact area. Thus, the fixing roller 3 and the pressing roller 7 may be properly heated. Namely, start-up may not take a longer time. The fixing belt 1 and the pressing roller 7 rotate at different linear speeds, respectively, reducing surface asperities of the fixing belt 1 and thereby suppressing formation of gloss stripes.

Figure 6A:
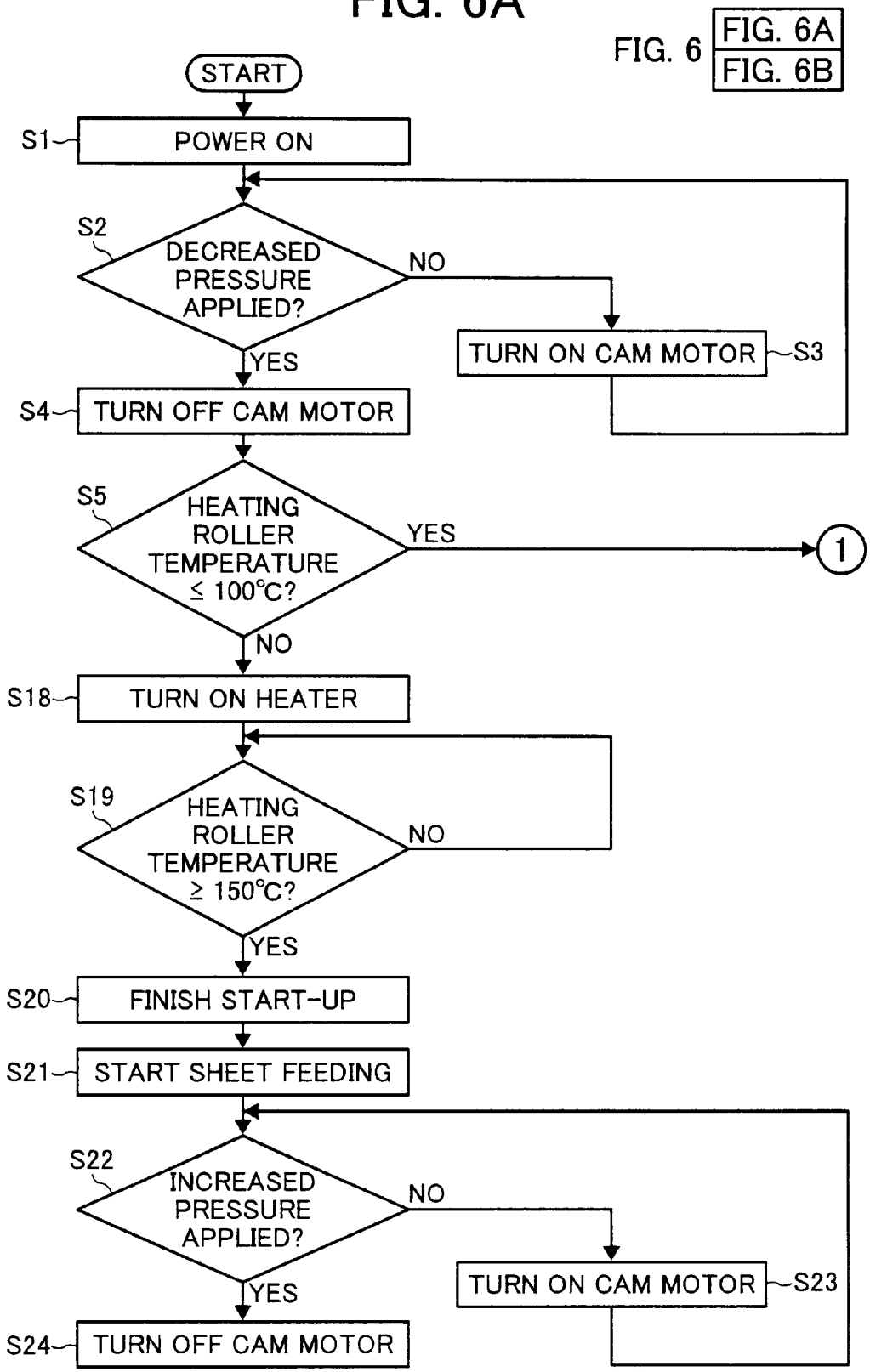
FIGS. 6A and 6B illustrate a flowchart of an exemplary fixing operation control of the fixing device shown in FIG. 2, when the fixing device is started up.
Figure 6B:
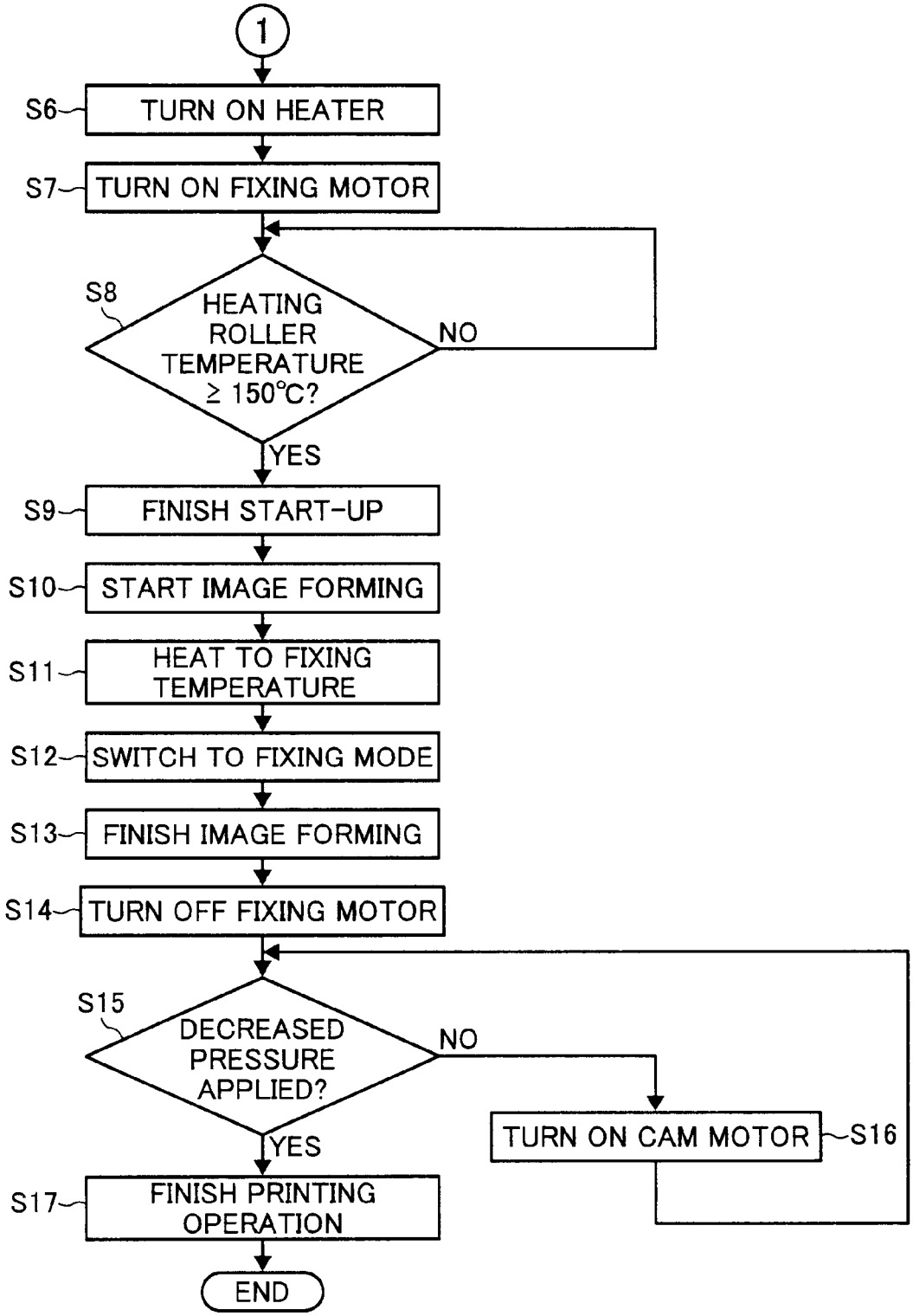

Referring to FIGS. 6A and 6B, the following describes an exemplary fixing operation control when the fixing device 50 is started up. In step S1, the fixing device 50 (depicted in FIG. 2) is powered on. In step S2, the controller 119 (depicted in FIG. 1) determines whether or not the fixing device 50 is in the non-fixing mode (i.e., the decreased pressure mode) in which the pressing roller 7 (depicted in FIG. 2) applies a decreased pressure to the fixing roller 3. If the fixing device 50 is not in the non-fixing mode (i.e., if NO is selected in step S2), a cam motor (not shown) for rotating the cam 10 (depicted in FIG. 2) is turned on in step S3. If the fixing device 50 is in the non-fixing mode (i.e., if YES is selected in step S2), the cam motor is turned off in step S4. In step S5, the controller 119 determines whether or not the temperature of the heating roller 2 (depicted in FIG. 2) is equal to or smaller than about 100 degrees centigrade. If the temperature of the heating roller 2 is equal to or smaller than about 100 degrees centigrade (i.e., if YES is selected in step S5), the heaters 4 and/or 5 (depicted in FIG. 2) are turned on in step S6. In step S7, the fixing motor 14 (depicted in FIG. 3) is turned on. In step S8, the controller 119 determines whether or not the temperature of the heating roller 2 is equal to or greater than about 150 degrees centigrade. If the temperature of the heating roller 2 is equal to or greater than about 150 degrees centigrade (i.e., if YES is selected in step S8), start-up of the fixing device 50 is finished in step S9. In step S10, an image forming operation starts. In step S11, the heating roller 2 is heated up to a fixing temperature. In step S12, the controller 119 controls the cam motor to switch the mode to the fixing mode (i.e., the increased pressure mode) in which the pressing roller 7 applies an increased pressure to the fixing roller 3. In step S13, the image forming operation is finished. In step S14, the fixing motor 14 is turned off. In step S15, the controller 119 determines whether or not the fixing device 50 is in the non-fixing mode. If the fixing device 50 is not in the non-fixing mode (i.e., if NO is selected in step S15), the cam motor is turned on in step S16. If the fixing device 50 is in the non-fixing mode (i.e., if YES is selected in step S15), a printing operation is finished in step S17.

If the temperature of the heating roller 2 is not equal to or smaller than about 100 degrees centigrade (i.e., if NO is selected in step S5), the heaters 4 and/or 5 are turned on in step S18. In step S19, the controller 119 determines whether or not the temperature of the heating roller 2 is equal to or greater than about 150 degrees centigrade. If the temperature of the heating roller 2 is equal to or greater than about 150 degrees centigrade (i.e., if YES is selected in step S19), start-up of the fixing device 50 is finished in step S20. In step S21, a sheet feeding operation starts. In step S22, the controller 119 determines whether or not the fixing device 50 is in the fixing mode. If the fixing device 50 is not in the fixing mode (i.e., if NO is selected in step S22), the cam motor is turned on in step S23. If the fixing device 50 is in the fixing mode (i.e., if YES is selected in step S22), the cam motor is turned off in step S24.

Steps S18 to S24 are performed when the fixing device 50 is in a standby mode. After start-up of the fixing device 50 is finished, the controller 119 controls the cam motor to switch the mode to the fixing mode in which the pressing roller 7 applies an increased pressure to the fixing roller 3.

The image forming apparatus 100 (depicted in FIG. 1) may have a configuration in which the fixing device 50 (depicted in FIG. 1) is driven even after a sheet passes through the fixing device 50. For example, when a driver (e.g., the fixing motor 14 depicted in FIG. 3) for driving the fixing device 50 drives the output roller pair 118 (depicted in FIG. 1), serving as a sheet conveyer for feeding the sheet which has passed through the fixing device 50 toward the outside of the image forming apparatus 100, the fixing device 50 is driven even after the sheet passes through the fixing device 50. When the fixing device 50 is driven in the fixing mode, the pressing roller 7 and the fixing roller 3 (depicted in FIG. 2) rotate for an increased number of rotations in a state in which an increased load is applied to the fixing belt 1 (depicted in FIG. 2) and the fixing roller 3, resulting in a reduced durability of the silicon sponge included in the fixing roller 3.

To cope with this problem, the fixing device 50 may enter the non-fixing mode after a last sheet of a plurality of sheets successively fixed in a print job passes through the fixing device 50. Thus, even when the fixing device 50 is driven after the sheet passes through the fixing device 50, durability of the fixing roller 3 and the fixing belt 1 may not be reduced.

Figure 7:
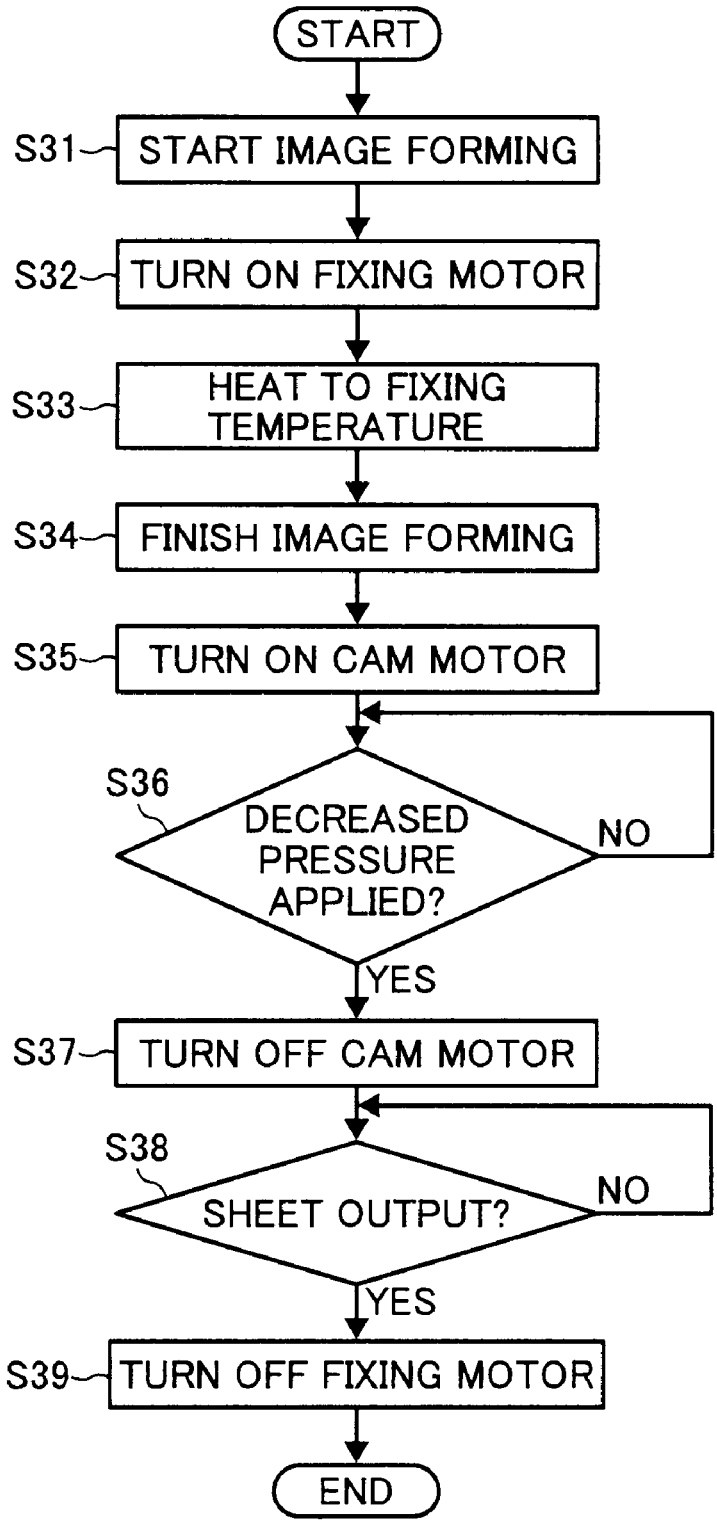
FIG. 7 is a flowchart of an exemplary fixing operation control of the fixing device shown in FIG. 2, when the fixing device continues to be driven after a sheet passes through the fixing device.

Referring to FIG. 7, the following describes an exemplary fixing operation control when the fixing device 50 is driven even after a sheet passes through the fixing device 50. In step S31, an image forming operation starts. In step S32, the fixing motor 14 (depicted in FIG. 3) is turned on. In step S33, the heating roller 2 (depicted in FIG. 2) is heated up to a fixing temperature. In step S34, the image forming operation is finished. In step S35, a cam motor (not shown) for rotating the cam 10 (depicted in FIG. 2) is turned on. In step S36, the controller 119 (depicted in FIG. 1) determines whether or not the fixing device 50 (depicted in FIG. 2) is in the non-fixing mode (i.e., the decreased pressure mode) in which the pressing roller 7 (depicted in FIG. 2) applies a decreased pressure to the fixing roller 3 (depicted in FIG. 2). If the fixing device 50 is in the non-fixing mode (i.e., if YES is selected in step S36), the cam motor is turned off in step S37. In step S38, the controller 119 determines whether or not a sheet is output. If the sheet is output (i.e., if YES is selected in step S38), the fixing motor 14 is turned off in step S39.

The image forming apparatus 100 (depicted in FIG. 1) may have a configuration in which a fixing condition (e.g., a fixing temperature and a fixing linear speed) varies depending on sheet type (e.g., plain paper and thick paper). For example, a fixing temperature applied to thick paper may be greater than a fixing temperature applied to plain paper. When the fixing device 50 (depicted in FIG. 2) is driven in the fixing mode, an increased load is applied to the fixing roller 3 and the fixing belt 1 (depicted in FIG. 2). To cope with this problem, the fixing device 50 may enter the non-fixing mode. Thus, even when the fixing condition is changed, durability of the fixing roller 3 and the fixing belt 1 may not be reduced.

Figure 8A:
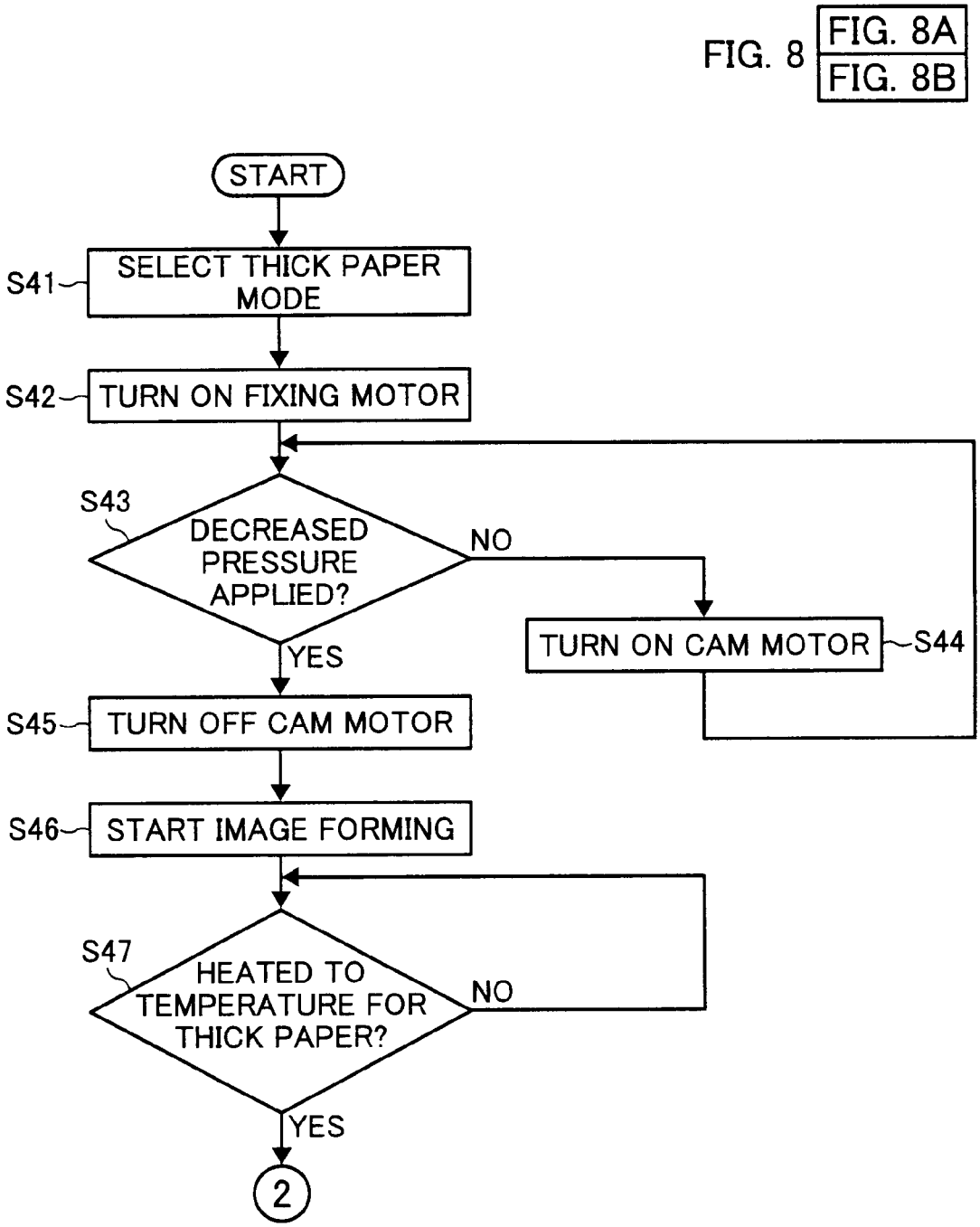
FIGS. 8A and 8B illustrate a flowchart of an exemplary fixing operation control of the fixing device shown in FIG. 2, when a fixing condition is changed in accordance with sheet type.
Figure 8B:
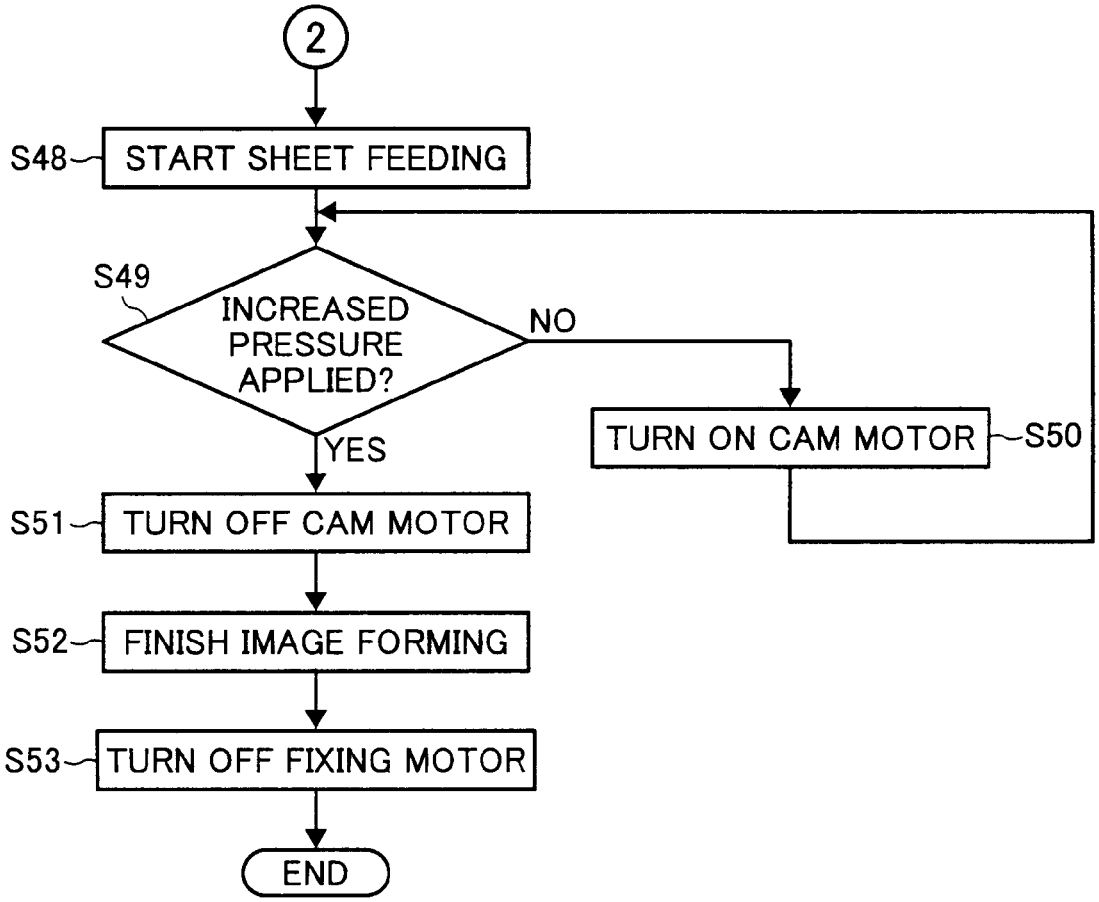

Referring to FIGS. 8A and 8B, the following describes an exemplary fixing operation control when the fixing condition is changed in accordance with sheet type. In step S41, a thick paper mode is selected (i.e., the fixing condition is changed to fit thick paper). In step S42, the fixing motor 14 (depicted in FIG. 3) is turned on. In step S43, the controller 119 (depicted in FIG. 1) determines whether or not the fixing device 50 (depicted in FIG. 2) is in the non-fixing mode (i.e., the decreased pressure mode) in which the pressing roller 7 (depicted in FIG. 2) applies a decreased pressure to the fixing roller 3 (depicted in FIG. 2). If the fixing device 50 is not in the non-fixing mode (i.e., if NO is selected in step S43), a cam motor (not shown) for rotating the cam 10 (depicted in FIG. 2) is turned on in step S44. If the fixing device 50 is in the non-fixing mode (i.e., if YES is selected in step S43), the cam motor is turned off in step S45. In step S46, an image forming operation starts. In step S47, the controller 119 determines whether or not the heating roller 2 or the fixing belt 1 (depicted in FIG. 2) has a temperature set for thick paper. If the heating roller 2 has the temperature set for thick paper (i.e., YES is selected in step S47), start-up of the fixing device 5 is finished, and thereby a sheet feeding operation starts in step S48. In step S49, the controller 119 determines whether or not the fixing device 50 is in the fixing mode (i.e., the increased pressure mode) in which the pressing roller 7 applies an increased pressure to the fixing roller 3. If the fixing device 50 is not in the fixing mode (i.e., if NO is selected in step S49), the cam motor is turned on in step S50. If the fixing device 50 is in the fixing mode (i.e., if YES is selected in step S49), the cam motor is turned off in step S51. In step S52, the image forming operation is finished. In step S53, the fixing motor 14 is turned off.

As illustrated in FIG. 2, in the fixing device 50, the mode may be switched between the fixing mode (i.e., the increased pressure mode) in which the pressing roller 7 applies an increased pressure to the fixing roller 3 and the non-fixing mode (i.e., the decreased pressure mode) in which the pressing roller 7 applies a decreased pressure to the fixing roller 3, while the pressing roller 7 and the fixing roller 3 rotate. Thus, durability of the fixing belt 1 and the fixing roller 3 including a silicon sponge layer (i.e., the elastic layer 3B) may be improved without affecting heating of the fixing device 50.

Even when paper dust generates during fixing operation, the paper dust may not scrape the fixing belt 1 in the fixing mode in which the fixing belt 1 and the pressing roller 7 rotate at substantially identical linear speeds. In the non-fixing mode, the fixing belt 1 and the pressing roller 7 rotating at linear speeds different from each other may scatter paper dust, preventing the paper dust from scraping the fixing belt 1. Thus, durability of the fixing belt 1 and the fixing roller 3 may be improved. The pressing roller 7 rotating at the linear speed different from the linear speed of the fixing belt 1 may reduce surface asperities of the fixing belt 1, suppressing formation of gloss stripes.

The fixing roller 3 and the pressing roller 7 may rotate in the non-fixing mode with a simple structure. The pressing roller 7 applies a decreased pressure to the fixing roller 3 in the non-fixing mode until start-up of the fixing device 50 is finished. Namely, the number of rotations of the fixing roller 3 and the fixing belt 1 in a state in which an increased load is applied to the fixing roller 3 and the fixing belt 1 may be reduced, improving durability of the fixing roller 3 and the fixing belt 1 and suppressing formation of gloss stripes.

When a fixing operation is finished, the fixing device 50 enters the non-fixing mode, resulting in an improved durability of the fixing roller 3 and the fixing belt 1. The fixing device 50 is in the fixing mode while a sheet is conveyed in the fixing device 50, improving durability of the fixing roller 3 and the fixing belt 1.

Durability of the fixing roller 3 and the fixing belt 1 may be improved without a complex control. When the fixing device 50 is driven while a sheet is fed in a downstream portion from the fixing device 50 in a sheet-conveyance direction, the fixing device 50 may be in the non-fixing mode, preventing a decreased durability of the fixing roller 3 and the fixing belt 1.

After a fixing condition is changed, the fixing device 50 may be started up or activated in the non-fixing mode, preventing a decreased durability of the fixing roller 3 and the fixing belt 1. An increased temperature may be applied to thick paper as a fixing temperature, resulting in an improved durability of the fixing roller 3 and the fixing belt 1.

As illustrated in FIG. 2, according to the above-described exemplary embodiments, the fixing belt 1 is looped over the heating roller 2 and the fixing roller 3. However, the fixing belt 1 may be looped over a support roller, for example. A halogen heater, an induction heater, or the like may be used as the heater 4 or 5. A combination of an elastic member and a solenoid or the like may replace the cam 10 to adjust a pressure applied by the pressing roller 7 to the fixing belt 1. Switch between the fixing mode and the non-fixing mode (i.e., adjustment of a pressure applied by the pressing roller 7 to the fixing roller 3) may be controlled with any proper structure or configuration other than the above-described structures and configurations.

The image forming apparatus 100 (depicted in FIG. 1) may have any proper structure and configuration other than the above-described structures and configurations, respectively. The image forming apparatus 100 may use any proper image forming method other than the above-described methods. The image forming apparatus 100 may be a printer, a copying machine, a facsimile, a plotter, or a multifunction printer including two or more of printing, copying, scanning, and facsimile functions, and may form a monochrome, multicolor, or full-color image.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image forming device configured to form a toner image on a sheet; and a fixing device configured to fix the toner image on the sheet, the fixing device including a fixing belt having an endless belt-like shape, a heater configured to heat the fixing belt, a fixing roller including an elastic layer including a silicon sponge, a pressing roller configured to apply a pressure to the fixing roller via the fixing belt to form a nip at which the toner image is fixed on the sheet between the pressing roller and the fixing belt, a controller configured to switch the fixing device between an increased pressure mode and a decreased pressure mode in a state in which the fixing roller and the pressing roller rotate, and a moving mechanism configured to move the pressing roller to a first position at which the pressing roller applies an increased pressure capable of fixing the toner image on the sheet to the fixing roller in the increased pressure mode and to a second position at which the pressing roller applies a decreased pressure incapable of fixing the toner image on the sheet to the fixing roller in the decreased pressure mode.

2. The image forming apparatus according to claim 1, wherein in the increased pressure mode the pressing roller and the fixing belt rotate at the nip formed between the pressing roller and the fixing belt at substantially identical linear speeds, and wherein in the decreased pressure mode the pressing roller and the fixing belt rotate at the nip formed between the pressing roller and the fixing belt at linear speeds different from each other.

3. The image forming apparatus according to claim 1, wherein the fixing device further includes a fixing roller gear attached to a shaft of the fixing roller, and a pressing roller gear attached to a shaft of the pressing roller and configured to engage the fixing roller gear, so that a driving force is transmitted from the fixing roller to the pressing roller via the fixing roller gear and the pressing roller gear, and wherein the pressing roller gear continues to engage the fixing roller gear in the decreased pressure mode.

4. image forming apparatus according to claim 1, wherein the fixing device is in the decreased pressure mode when the fixing device is activated and the controller switches the fixing device to the increased pressure mode after the fixing device is activated.

5. The image forming apparatus according to claim 1, wherein the controller switches the fixing device to the decreased pressure mode after a fixing operation is finished.

6. The image forming apparatus according to claim 1, wherein the fixing device is in the increased pressure mode when a sheet bearing the toner image is conveyed in the fixing device.

7. The image forming apparatus according to claim 1, wherein the controller switches the fixing device to the decreased pressure mode after a last sheet of a plurality of sheets successively fixed passes through the fixing device.

8. The image forming apparatus according to claim 7, further comprising:

a driver configured to drive the fixing device; and a sheet conveyer provided downstream from the fixing device in a sheet-conveyance direction, the sheet conveyer driven by the driver.

9. The image forming apparatus according to claim 1, wherein the fixing device is activated in the decreased pressure mode after fixing conditions are changed and the controller switches the fixing device to the increased pressure mode after the fixing device is activated.

10. The image forming apparatus according to claim 9, wherein the fixing conditions include a fixing temperature.

11. A fixing device for fixing a toner image on a sheet, comprising:

a fixing belt having an endless belt-like shape;

a heater configured to heat the fixing belt;

a fixing roller including an elastic layer including a silicon sponge;

a pressing roller configured to apply a pressure to the fixing roller via the fixing belt to form a nip at which the toner image is fixed on the sheet between the pressing roller and the fixing belt;

a controller configured to switch the fixing device between an increased pressure mode and a decreased pressure mode in a state in which the fixing roller and the pressing roller rotate, and a moving mechanism configured to move the pressing roller to a first position at which the pressing roller applies an increased pressure capable of fixing the toner image on the sheet to the fixing roller in the increased pressure mode and to a second position at which the pressing roller applies a decreased pressure incapable of fixing the toner image on the sheet to the fixing roller in the decreased pressure mode.

12. The fixing device according to claim 11, further comprising:

a fixing roller gear attached to a shaft of the fixing roller; and a pressing roller gear attached to a shaft of the pressing roller and configured to engage the fixing roller gear, so that a driving force is transmitted from the fixing roller to the pressing roller via the fixing roller gear and the pressing roller gear, wherein the pressing roller gear continues to engage the fixing roller gear in the decreased pressure mode.

13. An image forming method, comprising:

forming a toner image on a sheet;

rotating a pressing roller and a fixing roller in a state in which the pressing roller applies a pressure to the fixing roller via a fixing belt to form a nip between the pressing roller and the fixing belt;

controlling the pressing roller so as to apply a decreased pressure to the fixing roller via the fixing belt, the decreased pressure is incapable of fixing the toner image on the sheet;

moving the pressing roller to a first position at which the pressing roller applies an increased pressure to the fixing roller via the fixing belt to fix the toner image on the sheet.

14. The image forming method according to claim 13, wherein the pressing roller and the fixing belt rotate at the nip formed between the pressing roller and the fixing belt at substantially identical linear speeds when the pressing roller applies the increased pressure to the fixing roller via the fixing belt, and wherein the pressing roller and the fixing belt rotate at the nip formed between the pressing roller and the fixing belt at linear speeds different from each other when the pressing roller applies the decreased pressure to the fixing roller via the fixing belt.

15. The image forming method according to claim 13, further comprising:

engaging a gear attached to a shaft of the fixing roller with a gear attached to a shaft of the pressing roller so as to continue to transmit a driving force from the fixing roller to the pressing roller via the gears when the pressing roller applies the decreased pressure to the fixing roller via the fixing belt.

16. The image forming method according to claim 13, wherein the pressing roller applies the decreased pressure to the fixing roller via the fixing belt when a fixing device, including the pressing roller, the fixing roller, and the fixing belt, is activated, and wherein the pressing roller applies the increased pressure to the fixing roller via the fixing belt after the fixing device is activated.

17. The image forming method according to claim 13, wherein the pressing roller applies the decreased pressure to the fixing roller via the fixing belt after a fixing operation is finished.

18. The image forming method according to claim 13, wherein the pressing roller applies the increased pressure to the fixing roller via the fixing belt when a sheet bearing the toner image is conveyed in a fixing device including the pressing roller, the fixing roller, and the fixing belt.

19. The image forming method according to claim 13, wherein the pressing roller applies the decreased pressure to the fixing roller via the fixing belt after a last sheet of a plurality of sheets successively fixed passes through a fixing device including the pressing roller, the fixing roller, and the fixing belt.

20. The image forming method according to claim 13, further comprising:

changing fixing conditions, wherein the pressing roller applies the decreased pressure to the fixing roller via the fixing belt when a fixing device, including the pressing roller, the fixing roller, and the fixing belt, is activated after the fixing conditions are changed, and wherein the pressing roller applies the increased pressure to the fixing roller via the fixing belt after the fixing device is activated.

* * * * *